US011821277B2

(12) United States Patent
Feliu et al.

(10) Patent No.: US 11,821,277 B2
(45) Date of Patent: Nov. 21, 2023

(54) DOWNHOLE TOOL FOR JARRING

(71) Applicant: Schlumberger Technology Corporation, Sugar Land, TX (US)

(72) Inventors: Rodrigo Feliu, Katy, TX (US); Matthew Billingham, Paris (FR); Robert Kyle Wiesenborn, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/823,757

(22) Filed: Aug. 31, 2022

(65) Prior Publication Data

US 2023/0066142 A1 Mar. 2, 2023

Related U.S. Application Data

(60) Provisional application No. 63/260,760, filed on Aug. 31, 2021.

(51) Int. Cl.
*E21B 31/107* (2006.01)

(52) U.S. Cl.
CPC ..... *E21B 31/107* (2013.01)

(58) Field of Classification Search
CPC ..... E21B 31/107
See application file for complete search history.

(56) References Cited

U.S. PATENT DOCUMENTS 1,030,992 A 7/1912 Fulmer
1,785,419 A 12/1930 Moss
2,160,150 A 5/1939 Jimerson et al.
2,500,402 A 3/1950 Ernest
2,588,408 A 3/1952 O'leary
2,713,992 A 7/1955 Snyder
3,167,122 A 1/1965 Lang
(Continued)

FOREIGN PATENT DOCUMENTS

CN 101012746 A 8/2007
CN 102102510 A 6/2011
(Continued)

OTHER PUBLICATIONS

International Search Report and Written Opinion issued in PCT Application PCT/US2018/052171 dated Jan. 17, 2019 (18 pages).
(Continued)

*Primary Examiner* — Shane Bomar
(74) *Attorney, Agent, or Firm* — Jeffrey D. Frantz

(57) ABSTRACT

Examples described herein include systems and methods associated with a mechanical service tool. In one example, the service tool includes a power jar, an accelerator, and a linear actuator. The accelerator can be coupled to the power jar and provide assistance to the power jar. The linear actuator can be coupled to the accelerator and configured such to pull the accelerator spring within the accelerator with a force sufficient to fire the power jar. When the power jar is in a released state, the linear actuator can also be used to push or pull the entire accelerator and power jar assembly, which in turn can push or pull the target object within the wellbore. The linear actuator can also be used to move the power jar from a released state to a set state.

20 Claims, 9 Drawing Sheets

(56) References Cited

U.S. PATENT DOCUMENTS

| | | | | |
|---|---|---|---|---|
| 3,225,828 | A | 12/1965 | Wisenbaker et al. | |
| 4,325,436 | A | 4/1982 | Richter et al. | |
| 5,069,282 | A * | 12/1991 | Taylor | E21B 31/107 166/301 |
| 5,170,843 | A * | 12/1992 | Taylor | E21B 31/107 166/301 |
| 5,695,015 | A | 12/1997 | Barr et al. | |
| 5,706,896 | A | 1/1998 | Tubel et al. | |
| 5,785,120 | A | 7/1998 | Smalley et al. | |
| 5,899,268 | A | 5/1999 | Lynde et al. | |
| 6,668,945 | B2 | 12/2003 | Ohmer | |
| 6,851,475 | B2 | 2/2005 | Simpson et al. | |
| 6,868,901 | B2 | 3/2005 | Mason et al. | |
| 7,575,056 | B2 | 8/2009 | Fuhst et al. | |
| 7,909,100 | B2 | 3/2011 | Bryant, Jr. et al. | |
| 8,789,598 | B1 | 7/2014 | Mlcak et al. | |
| 10,683,719 | B2 | 6/2020 | Motland | |
| 2003/0234121 | A1* | 12/2003 | Taylor | E21B 31/107 166/177.6 |
| 2005/0092494 | A1 | 5/2005 | McElroy et al. | |
| 2005/0092495 | A1 | 5/2005 | Evans | |
| 2005/0150693 | A1 | 7/2005 | Madden | |
| 2006/0169456 | A1* | 8/2006 | Evans | E21B 31/1135 166/301 |
| 2006/0207796 | A1 | 9/2006 | Stewart | |
| 2007/0084637 | A1 | 4/2007 | Orban et al. | |
| 2007/0151732 | A1* | 7/2007 | Clemens | E21B 31/107 166/301 |
| 2008/0087424 | A1 | 4/2008 | McLaughlin | |
| 2010/0258293 | A1 | 10/2010 | Lynde et al. | |
| 2011/0297380 | A1 | 12/2011 | Alberty et al. | |
| 2012/0029702 | A1 | 2/2012 | Tverlid | |
| 2012/0043089 | A1 | 2/2012 | Hoffman et al. | |
| 2014/0124191 | A1 | 5/2014 | Hallundbæk | |
| 2014/0311729 | A1 | 10/2014 | Pasvandi | |
| 2014/0360784 | A1 | 12/2014 | Hunziker et al. | |
| 2016/0032696 | A1 | 2/2016 | Caccialupi et al. | |
| 2016/0130904 | A1 | 5/2016 | Andersen | |
| 2016/0258254 | A1* | 9/2016 | Guo | H02K 35/02 |
| 2017/0175475 | A1* | 6/2017 | Kartha | E21B 47/12 |
| 2020/0190951 | A1 | 6/2020 | Teurlay et al. | |
| 2020/0332615 | A1 | 10/2020 | Wiesenborn et al. | |

FOREIGN PATENT DOCUMENTS

| | | | |
|---|---|---|---|
| CN | 106194158 | A | 6/2016 |
| CN | 106687242 | A | 5/2017 |
| EP | 2813665 | A1 | 12/2014 |
| GB | 2129350 | A | 5/1984 |
| WO | 03069116 | A1 | 8/2003 |
| WO | 2010085154 | A9 | 9/2010 |
| WO | 2012054445 | A2 | 4/2012 |
| WO | 2012074755 | A3 | 8/2012 |
| WO | 2013134629 | A1 | 9/2013 |
| WO | 2015112022 | A1 | 7/2015 |
| WO | 2016028155 | A1 | 2/2016 |
| WO | 2016085490 | A1 | 6/2016 |
| WO | 2020006333 | A1 | 1/2020 |

OTHER PUBLICATIONS

International Search Report and Written Opinion issued in PCT Application PCT/US2018/052164 dated Mar. 6, 2019 (12 pages).
International Preliminary Report on patentability issued in PCT Application PCT/US2018/052171 dated Apr. 2, 2020 (15 pages).
International Preliminary Report on Patentability issued in PCT Application PCT/US2018/052164 dated Apr. 2, 2020 (8 pages).
Partial Supplementary Search Report of European Patent Application No. 18858532.7 dated May 18, 2021, 11 pages.
Extended Search Report of European Patent Application No. 18858532.7 dated Oct. 4, 2021, 10 pages.
Search Report of Chinese Patent Application No. 201880075070X dated Nov. 10, 2021, 7 pages with English Translation.
Substanative Exam issued in Saudi Arabian Patent Application No. 520411583 dated Mar. 29, 2022, 11 pages with English translation.
Second Office Action issued in Chinese Patent Application No. 201880075070.X dated Jun. 15, 2022, 9 pages with English translation.
Substantive Examination Report issued in Saudi Arabian Patent Application No. 520411583 dated Sep. 26, 2022, 10 pages with English translation.
Search Report and Written Opinion issued in the PCT Application PCT/US2022/035067 dated Oct. 18, 2022, 11 pages.
Office Action issued in U.S. Appl. No. 16/649,478 dated Oct. 18, 2021, 9 pages.
Office Action issued in U.S. Appl. No. 16/649,478 dated Apr. 4, 2022, 17 pages.
Notice of Allowance issued in U.S. Appl. No. 16/649,478 dated Sep. 23, 2022, 7 pages.
Search Report and Written Opinion issued in the PCT Application PCT/US2022/035083 dated Oct. 14, 2022, 12 pages.
Third Office Action issued in Chinese Patent Application No. 201880075070.X dated Oct. 21, 2022, 11 pages with English translation.
International Search Report and Written Opinion issued in the PCT Application PCT/US2022/042166 dated Dec. 9, 2022, 12 pages.

* cited by examiner

DOWNHOLE TOOL FOR JARRING

CROSS-REFERENCE TO RELATED APPLICATION

This application claims priority to and the benefit of U.S. Provisional Patent Application No. 63/260,760, filed on Aug. 31, 2021, which is incorporated by reference herein in its entirety for all purposes.

BACKGROUND

In the oil and gas industry, wireline cables are used to lower downhole tools into a wellbore to perform various services. A wireline cable (also referred to herein as a "wireline" or "cable" herein) can include electrical cabling capable of conveying power and data, to control tools and acquire real-time data from their operation.

Due to the nature of downhole operations, tools occasionally become stuck in the wellbore. This can happen for any number of reasons, such as the tool malfunctioning, the wellbore walls collapsing, or debris in the wellbore, to name a few examples. The risk of a stuck tool is also greater when the tool is used in a non-vertical wellbore, as the tool rests against the side of the wellbore and can more readily catch a protrusion or debris.

Stuck tools are typically removed by pulling or jarring. Pulling refers to applying a continuing force to the tool in order to physically pull the tool back uphole. Pulling can be performed by applying tension to the cable, for example. It can also be performed by a linear actuator on the tool or a related attachment, where the linear actuator provides the pulling force against the tool. Jarring refers to applying an impulse, such as a hammer-like strike, to the stuck tool in hopes of jarring it loose. In most cases, a jar tool is actuated by applying tension to the cable, which loads a spring that eventually releases and imparts an impulse.

Generally speaking, the process of jarring is a slow one. It normally requires a jar tool to perform the jarring, then another tool to perform the pulling. This requires moving tools in and out of the wellbore, slowing down the recovery process. Additionally, jar tools are difficult to use in highly deviated wells, as friction causes excessive cable tension at the surface in order to produce sufficient tension at the jar tool, potentially causing the cable to break.

As a result, a need exists for an integrated jarring tool that utilizes a linear actuator to perform the pulling action while also including a jar tool, eliminating the need to alternate between different recovery tools and speeding up the tool recovery process.

SUMMARY

Examples described herein include systems and methods associated with a mechanical service tool. In one example, the service tool includes a power jar, an accelerator, and a linear actuator. The power jar can be a spring-based jarring tool. For example, it can include a jar spring and a hammer that impacts an anvil, where the spring can be loaded and released, causing the hammer to produce an impulse upon impact. This impulse is used to loosen a target object that may be stuck within the wellbore. The power jar can transition between a set state (where the power jar is ready to be powered up and fired) and a released state (after the power jar has fired and needs to be reset). The power jar can transition between the set state and released state by way of a collet being mechanically set or released based on a threshold force, or by an electric release built into the power jar.

The accelerator can be coupled to the power jar and provide assistance to the power jar. For example, the accelerator can include an accelerator spring that transfers force to the power jar. When the hammer in the power jar is released, the accelerator spring can impart an additional force to the hammer beyond what the jar spring already provides. In some examples, the service tool can include a release device between the accelerator and the power jar to assist with separating these components when necessary.

The linear actuator can be coupled to the accelerator and configured such that actuation of the linear actuator imparts force to the accelerator. For example, the linear actuator can be used to pull the accelerator spring within the accelerator, such as by imparting force to the accelerator sufficient to activate the power jar. When the power jar is in a released state, the linear actuator can also be used to push or pull the entire accelerator and power jar assembly, which in turn can push or pull the target object within the wellbore. This is especially useful when done immediately after a jarring impact that loosens the target object before pulling or pushing. The linear actuator can also be used to move the power jar from a released state to a set state. The linear actuator can include a force sensor and/or position sensor that measures force of position, respectively, of the linear actuator at a point in time.

The mechanical service tool can also include one or more anchors for securing a portion of the linear actuator relative to the wellbore, such that the linear actuator can operate the accelerator without moving the mechanical service tool within the wellbore. The anchor can be one or more protrusions that contact the inner surface of the wellbore to stabilize and/or centralize the service tool.

Methods of using the disclosed mechanical service tool are also provided herein. An example method includes inserting the mechanical service tool described above into a wellbore, coupling the mechanical service tool to a target object, and firing the power jar of the mechanical service tool by actuating the linear actuator. The method can also include anchoring the mechanical service tool by extending one or more anchors before firing. The method can further include actuating the linear actuator to apply a pulling force to the target object without firing the power jar. In one example, the method is performed without applying additional tension to the cable. The method can also include removing the mechanical service tool from the wellbore, which causes the target object to be removed as well.

Some or all portions of the example methods described herein can be performed using a non-transitory, computer-readable medium having instructions that, when executed by a processor associated with a computing device, cause the processor to perform the stages described. Additionally, the example methods summarized above can each be implemented in a system including, for example, a memory storage and a computing device having a processor that executes instructions to carry out some or all of the stages described.

Both the foregoing general description and the following detailed description are exemplary and explanatory only and are not restrictive of the examples, as claimed.

DESCRIPTION OF THE EXAMPLES

Reference will now be made in detail to the present examples, including examples illustrated in the accompanying drawings. Examples described herein include systems and methods associated with a mechanical service tool. In one example, the service tool includes a power jar (also referred to herein as a "jar" or "jar tool"), an accelerator, and a linear actuator. The accelerator can be coupled to the power jar and provide assistance to the power jar. The linear actuator can be coupled to the accelerator and configured such to pull the accelerator spring within the accelerator with a force sufficient to fire the power jar. When the power jar is in a released state, the linear actuator can also be used to push or pull the entire accelerator and power jar assembly, which in turn can push or pull the target object within the wellbore. The linear actuator can also be used to move the power jar from a released state to a set state.

Figure 1:
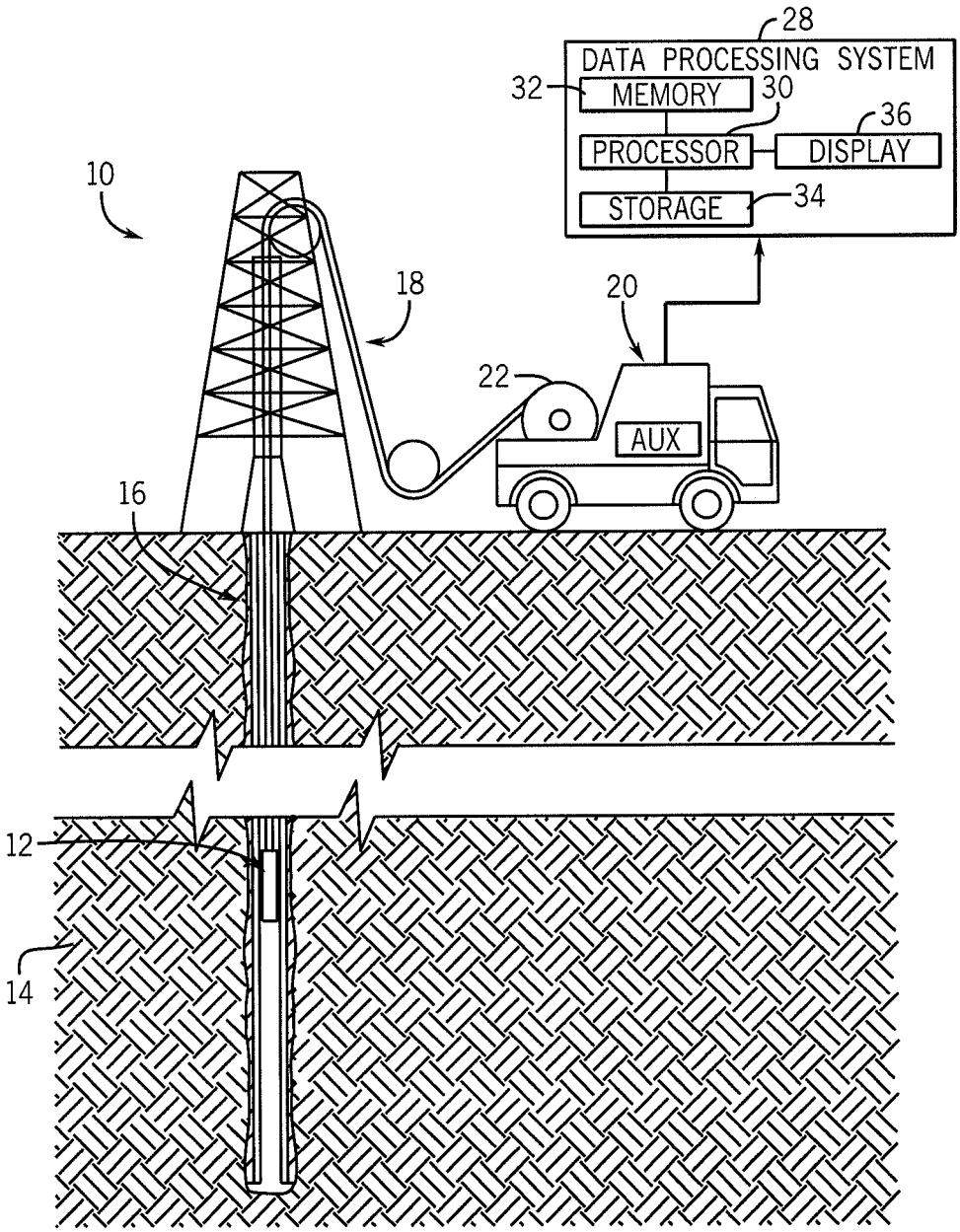
FIG. 1 is an illustration of a generic tool being placed within a wellbore using a wireline connected to the tool by an example wireline head.

FIG. 1 shows an exemplary well site where a mechanical service tool of the present invention may be utilized. A formation 14 has a drilled and completed wellbore 16. A derrick 10 above ground may be used to raise and lower components into the wellbore 16 and otherwise assist with well operations.

A wireline surface system 20 at the ground level includes a wireline logging unit, a wireline depth control system 22 having a cable 18, and an electronic control system 28. The cable 18 is connected to a mechanical service tool 12 that may be lowered downhole. The electronic control system 28 includes a processor 30, memory 32, storage 34, and display 36 that may be used to control various operations of the wireline surface system 20, send and receive data, and store data.

The wireline surface system 20 can deploy the cable 18, which in turn lowers the mechanical service tool 12 deeper downhole. Conversely, the wireline surface system 20 can retract the cable 18 and raise the mechanical service tool 12, including to the surface. The cable 18 is deployed or retracted by the wireline depth control system 22, such as by unwinding or winding the cable 18 around a spool that is driven by a motor.

The wireline logging unit communicates with the electronic control system 28 to send and receive data and control signals. For example, the wireline logging unit can communicate data received from the mechanical service tool 12 to the electronic control system 28. The wireline logging unit likewise can communicate data and control signals received from the electronic control system 28 to the mechanical service tool 12.

Figure 2:
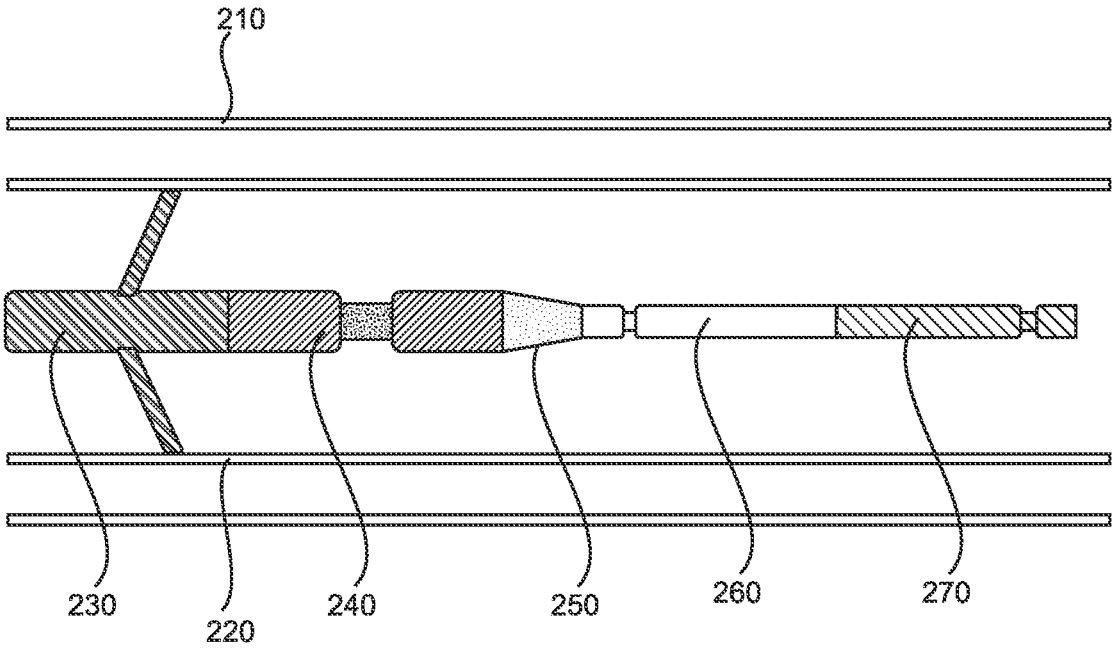
FIG. 2 is a representation of a mechanical service tool as disclosed herein.

FIG. 2 is an illustration of an example mechanical service tool disposed within a casing 220 of the wellbore 210. In some embodiments, the mechanical service tool may be disposed directly within the wellbore 210 without the casing 220. As described in more detail herein, the mechanical service tool may be used to perform various mechanical operations (e.g., jarring, shifting, milling, grinding, cutting, fishing) within the casing 220 and/or against the formation along the wall of the wellbore 210. The mechanical service tool may include an anchor portion 230, a linear actuator 240, a crossover module 250 that couples the linear actuator 240 to an accelerator 260, and a jar tool 270. The tool can also include a control circuit.

The components of FIG. 2 are shown and described generally, with more specific detail provided in conjunction with subsequent drawings within this disclosure. As shown in FIG. 2, the anchor portion 230 can include anchors that restrict longitudinal and/or radial movement of the mechanical service tool with respect to the casing 220. The anchors may include friction pads that may extend radially from the mechanical service tool towards an interior surface of the casing 220. The friction pads may apply a force against the interior surface. In one embodiment, the force may be sufficient to support the weight of the mechanical service tool and prevent the mechanical service tool from sliding in the longitudinal direction within the casing. In another embodiment, the cable may additionally support a portion or all of the weight of the mechanical service tool. Additionally, or otherwise, the anchors may centralize the mechanical service tool within the casing 220 by ensuring that an axial centerline of the mechanical service tool and an axial centerline of the casing 220 are concentric. The anchors portion 230—and in some examples, additional portions of the tool—can contact tubing, casing, or wellbore, depending on the inner surface present at the location at which the tool is anchored.

When the anchor portion 230 is engaged, the portion of the linear actuator 240 that is coupled to the anchor portion 230 can be held in a relatively fixed position. That is, actuation of the linear actuator 240 can cause one end of the linear actuator 240 to move, while the other end remains fixed by way of its coupling to the anchor portion 230. As a result, the linear actuator can be used to push and pull against the remaining components 250, 260, 270 of the mechanical service tool.

In an example where the jar tool 270 is coupled to a target object, such as an object that is stuck in the wellbore, then the downhole end of the mechanical service tool can be held in a fixed position as well—at least until the target object is loosened or moved. In that example scenario, actuation of the linear actuator 240 would not move either end of the mechanical service tool. Instead, that linear movement can be transferred to the accelerator portion 260 and/or the jar tool 270. This can be accomplished based on the linear actuator being coupled directly to the jar tool 270 or the accelerator 260, or by being coupled to either of those components by way of an optional crossover portion 250. The crossover portion 250 can use standard sizes for fittings and other mechanical interfaces such that existing parts could be connected to one another in a new manner.

As shown in FIG. 2 then, the linear actuator 240 transfers linear movement to the accelerator 260 through the crossover portion 250. The accelerator 260 is described in more detail with respect to FIGS. 7A and 7B. The accelerator 260 can include a large compression spring that stores mechanical energy as tension is applied. The accelerator 260 can use stacked disc springs in one example. Tension causes the accelerator spring to store kinetic energy and, in turn, places tension on the jar tool 270. The jar tool 270, which is described in more detail with respect to FIGS. 4-6 and 8, can be latched to the target object and can include a manner, anvil, and a resettable mechanism designed to stay locked in place up to an adjustable firing tension. Once the firing tension is exceeded, the jar mechanism releases and the hammer is accelerated toward the anvil using the energy stored in the jar tool 270 as well as additional energy stored in the accelerator 260. When the hammer impacts the anvil, an impulse is transmitted through the jar tool 270 and into the target object.

In one embodiment, the mechanical service tool may include one or more sensors coupled to the mechanical service tool. The one or more sensors may couple to various components of the mechanical service tool such as the anchor portion 230, linear actuator 240, crossover module 250, accelerator 260, jar tool 270, or any additional component. The one or more sensors may collect pertinent data (e.g., measure displacement of the linear actuator 240) about the components of the mechanical service tool and transmit said data to the surface via the telemetry (e.g., via electrical or optical signals pulsed through the geological formation or via mud pulse telemetry). As set forth above, the data processing system 28 may process the data collected by the one or more sensors. The one or more sensors may additionally provide data about the position of the mechanical service tool within the wellbore 210.

In one embodiment, the mechanical service tool may include a communication and control system which may receive and process a portion or all of the data received by the one or more sensors. The communication and control system may additionally transmit said data to the data processing system via suitable telemetry. In another embodiment, the data processing system, communication and controls system, or an additional system may use the received data to automate a portion, or all of the machining operations set forth herein.

A controller may couple to the mechanical service tool. The controller may be operatively coupled to the data processing system and may operate a power unit (e.g., one or more electric motors). The power unit may actuate the linear actuator 240.

In another embodiment, the power unit may include a hydraulic system (e.g., hydraulic pump). In another embodiment, the power unit may be replaced, or used in combination with, an external power unit (e.g., an external hydraulic pump) which may be located at the surface of the wellbore. The external hydraulic pump may supply the hydraulic fluid required to operate the linear actuator.

The stroke required to preload the accelerator 260 and fire the jar 270 can be set to less than the full stroke available from the linear actuator 240. Then after firing the jar 270, the linear actuator 240 can continue stroking at the same anchor position until the jar 270 and accelerator 260 reach the end of stroke and full linear actuator 240 force is transferred to the target object. The linear actuator 240 position can be measured and controlled to allow the jar 270 to be reset and fired multiple times before then continuing the linear actuator 240 stroke to apply full linear actuator 240 force to the target object.

The jar tool 270 and accelerator 260 can be set to specific force settings required to preload the accelerator 260 and activate the firing mechanism of the jar 270. Accelerator preload and firing force setting is typically limited by the amount of cable tension that can be applied. In highly deviated or extended reach wells, the cable tension available is limited by friction forces from the cable and the wellbore. This means that the energy available to be stored in the accelerator and jar is reduced and jarring becomes ineffective. To solve this, the energy can be provided by electrical power on the wireline cable, which is converted to hydraulic power in the linear actuator 240. This linear actuator 240 can then provide the displacement and force required in order to preload the accelerator 260 and fire the jar 270 properly, restoring the effectiveness of the jar in these wells.

As an alternate embodiment, the electrical energy can also be converted to mechanical energy using a motor and screw to preload the accelerator 260 and jar 270. The linear displacement used to preload the accelerator 260 and fire the jar 270 can also be provided by a wireline tractor.

In cases where the stroke provided by the linear actuator 240 is not sufficient, the accelerator 260 can be modified to use stronger springs to store more energy in a shorter stroke length.

The linear actuator 240 provides axial force to push or pull the accelerator 260. The anchoring arms hold the anchor portion 230 in place while the accelerator 260 is pushed or pulled by the linear actuator 240 to energize the accelerator 260 for firing the jar 270.

In some embodiments, a controller causes the linear actuator 240 to extend or retract its rod, which, in turn, energizes the accelerator 260. The accelerator 260 and jar 270 can be reset by stroking down with the linear actuator 240 until it reaches the initial latched position. As an alternate embodiment the jar 270 and accelerator 260 can be reset by releasing the anchor 230 and letting the tool descend by gravity, or the jar 270 can be reset using a wireline tractor.

As an alternate embodiment, the anchor portion 230 can be repositioned after firing the jar 270 to achieve a stroke on the accelerator 260 and jar 270 that is greater than one full stroke from the linear actuator 240. Repositioning can be accomplished either by moving the toolstring using the cable or by moving the toolstring using a wireline tractor.

Figure 3:
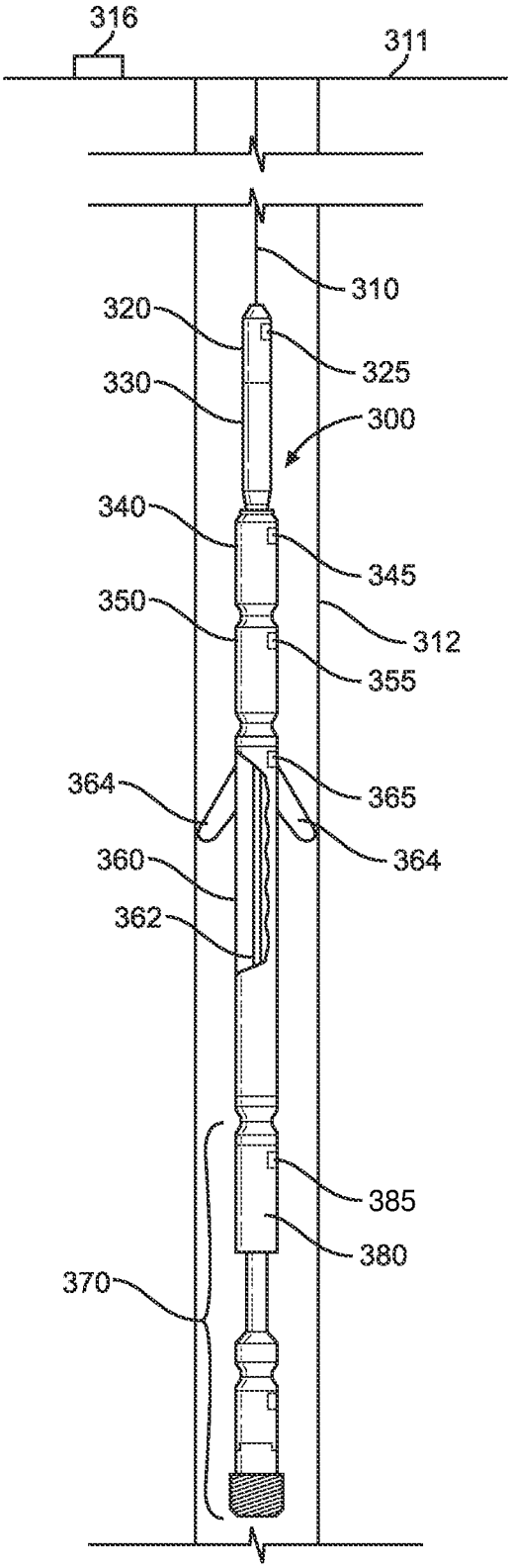
FIG. 3 is an illustration of an anchor mechanism and a linear actuator of the mechanical service tool disclosed herein.

FIG. 3 is an illustration of tool components including an anchor mechanism 230 and a linear actuator 240 of the mechanical service tool disclosed herein. These components are collectively referred to as tool 300. The representation of FIG. 3 does not include the entire mechanical service tool, but the anchor mechanism 230 and linear actuator 240 of FIG. 3 can be used in conjunction with the accelerator 260 and jar tool 270 as shown in FIG. 2.

The tool 300 may be configured to perform various intervention operations downhole, such as setting and retrieving plugs, opening and closing valves, cutting tubular elements, drilling through obstructions, performing cleaning and/or polishing operations, collecting debris, performing caliper runs, shifting sliding sleeves, performing milling operations, performing fishing operations, and other appropriate intervention operations. Some of these operations will be described in more detail in the paragraphs below.

In the embodiment of FIG. 3, the tool 300 includes a head assembly 320, a communications module 330, a drive electronics module 340, a hydraulic power module 350, an anchoring system 360, and a module 370, which may be any component or group of components, such as the accelerator 260, jar tool 270, and/or linear actuator 240 of FIG. 2.

The head assembly 320 may be configured to mechanically couple the tool 300 to a wireline 310. In one embodiment, the head assembly 320 includes a sensor 325 for measuring the amount of cable tension between the wireline 310 and the head assembly 320. Although a wireline 310 is shown in FIG. 3, in other embodiments other deployment mechanisms may be used, such as a coiled tubing string, a slickline, or drilling pipe, among other appropriate deployment mechanisms.

The communications module 330 may be configured to receive and send commands and data which are transmitted in digital form on the wireline 310. This communication is used to initiate, control and monitor the intervention operation performed by the intervention tool. The communications module 330 may also be configured to facilitate this communication between the drive electronics module 340 and a surface system 316 at the well surface 311. Such communication will be described in more detail in the paragraphs below. As such, the communications module 330 may operate as a telemetry device.

The drive electronics module 340 may be configured to control the operation of the module 370. The drive electronics module 340 may also be configured to control the hydraulic power module 350. As such, the drive electronics module 340 may include various electronic components (e.g., digital signal processors, power transistors, and the like) for controlling the operation of the module 370 and/or the hydraulic power module 350.

In one embodiment, the drive electronics module 340 may include a sensor 345 for measuring the temperature of the electronics contained therein. In another embodiment, the drive electronics module 340 may be configured to automatically turn off or shut down the operation of the electronics if the measured temperature exceeds a predetermined maximum operating temperature.

The hydraulic power module 350 may be configured to supply hydraulic power to various components of the tool 300, including the anchoring system 360 and the module 370. The hydraulic power module 350 may include a motor, a pump and other components that are typically part of a hydraulic power system. In one embodiment, the hydraulic power module 350 includes one or more sensors 355 for measuring the amount of pressure generated by the hydraulic power module 350. In another embodiment, the one or more hydraulic power module sensors 355 are used to measure the temperature of the motor inside the hydraulic power module 350. The pressure and/or temperature measurements may then be forwarded to the drive electronics module 340.

In response to receiving the measurements from the one or more hydraulic power module sensors 355, the drive electronics module 340 may determine whether the measured temperature exceeds a predetermined maximum operating temperature. If it is determined that the measured temperature exceeds the predetermined maximum operating temperature, then the drive electronics module 340 may automatically shut down or turn off the motor inside the hydraulic power module 350 to avoid overheating. Likewise, the drive electronics module 340 may monitor the measured pressure and control the hydraulic power module 350 to maintain a desired output pressure.

Alternatively, the drive electronics module 340 may forward the pressure and/or temperature measurements made by the one or more hydraulic power module sensors 355 to the surface system 316 through the communications module 330. In response to receiving these measurements, an operator at the well surface 311 may monitor and/or optimize the operation of the hydraulic power module 350, e.g., by manually turning off the motor or the pump of the hydraulic power module 350. Although the tool 300 is described with reference to a hydraulic power system, it should be understood that in some embodiments the tool 300 may use other types of power distribution systems, such as an electric power supply, a fuel cell, or another appropriate power system.

The anchoring system 360 may be configured to anchor the tool 300 to an inner surface of a wellbore wall 312, which may or may not include a casing, tubing, liner, or other tubular element. Alternatively, the anchoring system 360 may be used to anchor the tool 300 to any other appropriate fixed structure or to any other device that the tool 300 acts upon.

In one embodiment the anchoring system 360 includes a piston 362 which is coupled to a pair of arms 364 in a manner such that a linear movement of the piston 362 causes the arms 364 to extend radially outwardly toward the wellbore wall 312, thereby anchoring the tool 300 to the wellbore wall 312. In one embodiment, the anchoring system 360 includes one or more sensors 365 for measuring the linear displacement of the piston 362, which may then be used to determine the extent to which the arms 364 have moved toward the wellbore wall 312, and therefore the radial opening of the wellbore. In another embodiment, the one or more anchoring system sensors 365 are used to measure the amount of pressure exerted by the arms 364 against the wellbore wall 312. In yet another embodiment, the one or more anchoring system sensors 365 are used to measure the slippage of the tool 300 relative to the wellbore wall 312.

As with the measurements discussed above, the linear displacement, radial opening, pressure and/or slippage measurements made by the one or more anchoring system sensors 365 may be forwarded to the drive electronics module 340. In one embodiment, the drive electronics module 340 may forward those measurements to the surface system 160 through the communications module 330. Upon receipt of the measurements, the operator at the well surface 311 may then monitor, adjust and/or optimize the operation of the anchoring system 360.

In another embodiment, the drive electronics module 340 automatically adjusts or optimizes the operation of the anchoring system 360, such as by adjusting the linear displacement of the piston 362 so that the arms 364 may properly engage the wellbore wall 312 based on the linear displacement, radial opening, pressure and/or slippage measurements.

The tool 300 also includes a module 370, which is capable of performing various operations. In one embodiment, the module 370 includes a linear actuator module 380 and a connected module. The linear actuator module 380 may be configured to push or pull the connected module. The connected module can be any type of connection or other tool portion. For example, the connected module can include one or more of the crossover component 250, accelerator 260, or jar tool 270 as shown in FIG. 2.

In one embodiment, the linear actuator module 380 includes one or more sensors 385 for measuring the linear displacement of the linear actuator. In another embodiment, the one or more linear actuator sensors 385 are used to measure the amount of force exerted by the linear actuator module 380. As with other measurements discussed above, the linear displacement and/or force measurements made by the one or more linear actuator sensors 385 may be forwarded to the drive electronics module 340, which may then forward these measurements to the surface system 316 through the communications module 330. Upon receipt of the linear displacement and/or force measurements, the operator at the well surface 312 may monitor and/or optimize the operation of the linear actuator module 380.

In one embodiment, the drive electronics module 340 may automatically adjust the linear displacement of the linear actuator module 380 and the amount of force exerted by the linear actuator module 380 based on the linear displacement and/or force measurements made by the one or more linear actuator sensors 385.

In one embodiment, a tractor is disposed between the communications module 330 and the drive electronics module 340 to deploy the tool 300 downhole. Once the tool 300 has been set at a desired location in the wellbore 312, the tractor may be turned off. In this manner, the tool 300 may be modular.

Figure 4:
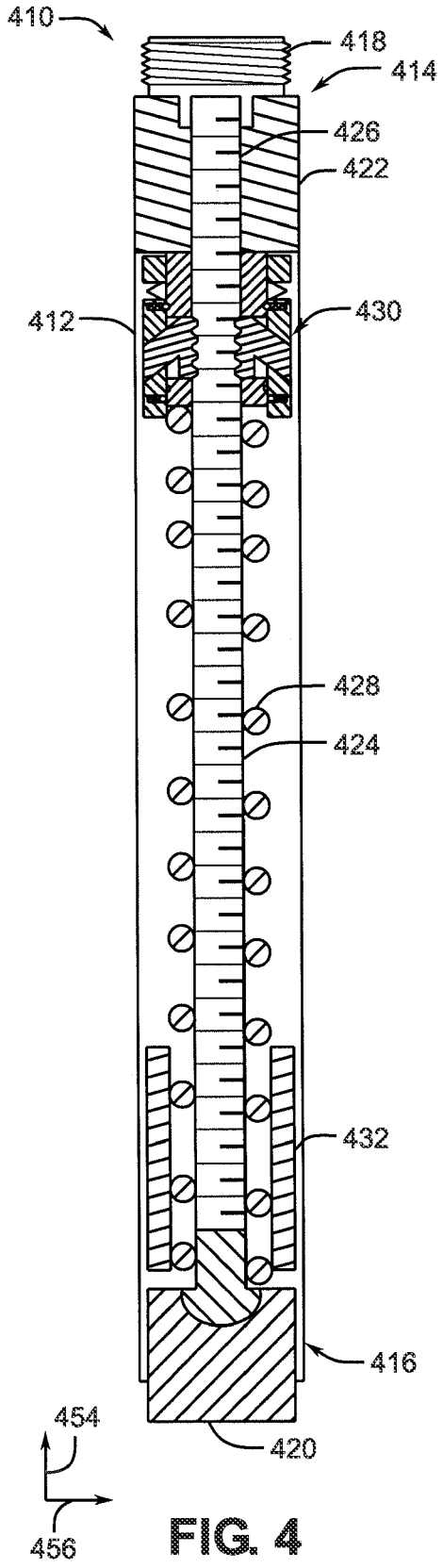
FIG. 4 is a cross-sectional illustration of an example jar tool of the mechanical service tool disclosed herein.

FIG. 4 illustrates a jar tool 410 that may couple to the accelerator 260 of the mechanical service tool 12. The jar tool 410 of FIG. 4 can be the same jar tool 270 described with respect to FIG. 2. The jar tool 410 may loosen the mechanical service tool 12 from a constriction within the wellbore 16. For example, in one embodiment, the geological formation 14 may shift and hence restrict a diameter (e.g., form the constriction) of the wellbore 16. In this embodiment, the wellbore 16 may pin (e.g., restrict longitudinal 454 movement) the mechanical service tool 12 within the casing 220 and/or the wellbore 16. The jar tool 410 may loosen the mechanical service tool 12 from the wellbore 16 by providing a longitudinal 454 force to the mechanical service tool 12.

The jar tool 410 may include a jar body 412 that includes an upper end portion 414 and a lower end portion 416. In one embodiment, the upper end portion 414 may include threads 418 which may couple the jar tool 410 to the mechanical service tool 12. In another embodiment, the jar tool 410 may include a downhole tool 420 coupled to the lower end portion 416 of the jar body 412. The jar tool 410 may include an anvil 422 that may receive an impulse (e.g., a force associated with a sudden change in momentum) from a hammer 430 (e.g. a spring loaded shuttle), the impulse being then transmitted to the jar body 412. The hammer 430 may be accelerated (e.g., via the spring 428, gravity) and rapidly halted by the anvil 422 such to create the impulse. The anvil 422 may be located near the upper end portion 414 and the hammer 430 nearer the lower end portion 416 of the jar tool 410 and may hence generate an impact force in the upward longitudinal 454 direction. In another embodiment, the anvil 422 may be located near the lower end portion 416 and the hammer 430 nearer the upper end portion 414 of the jar tool 410 and may hence generate an impact in the downward longitudinal 454 direction. The impact force may be transferred to the mechanical service tool 12 via the threads 418 and may free the mechanical service tool 12 from the construction within the casing 220 and/or the wellbore 16.

In one embodiment, a threaded shaft 424 may protrude through an opening 426 in the anvil 422. A spring 428 may be disposed within the jar body 412 and may include an upper end portion coupled to a hammer assembly 430 and a lower end portion coupled to a retaining sleeve 432. As described in greater detail herein, the hammer assembly 430 striking the anvil 422 may generate the impulse, and hence the longitudinal 454 force. The hammer 430 may be moved to a staging position such that the hammer 430 may be accelerated and collide with an impact position to create the impact force along the longitudinal 454 direction.

Figure 5:
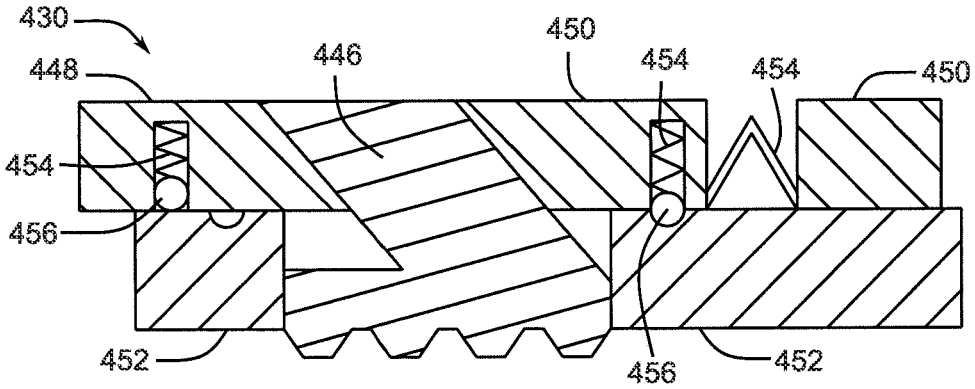
FIG. 5 is a cross-sectional illustration of an example hammer assembly of the jar tool in a set position.

FIG. 5 shows a close-up perspective view of the hammer assembly 430 of FIG. 4. The hammer assembly 430 may include a thread retainer 446 which may couple to the threaded shaft 424 and move the hammer 430 within the jar body 412. In one embodiment, a latching ring 448 and a reset ring 450 may apply a force onto the thread retainer 446 and against the hammer sleeve 452 to couple or decouple the hammer 430 from the threaded shaft 424. Additionally or otherwise, a hammer sleeve 452 may move to the staging position. One or more springs 454 may be used with a position lock 456 to restrict the hammer sleeve 452 in the staging position.

Figure 6:
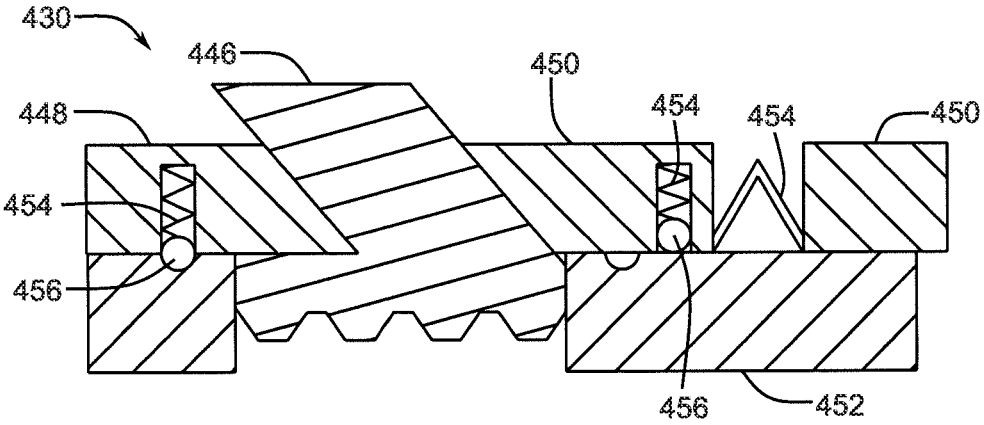
FIG. 6 is a cross-sectional illustration of an example hammer assembly of the jar tool in a released position.

FIG. 6 shows the hammer assembly 430 in a released position. In one embodiment, the hammer sleeve 452 may shift the thread retainer 446 which may decouple the hammer 452 from the threaded shaft 424. In another embodiment, the spring 428 may accelerate the hammer assembly 430 to the impact position (e.g., the lower end portion 416 of the jar body 412) which may generate the impact force. The jar tool may be a power jar. The jar tool may also be a hydraulic jar. In another embodiment, the thread retainer 446 and threaded shaft 424 may be replaced by a collet latch which may be moved from the staging position to the released position by longitudinal displacement of a moveable pin within the collet latch assembly.

Figure 7A:
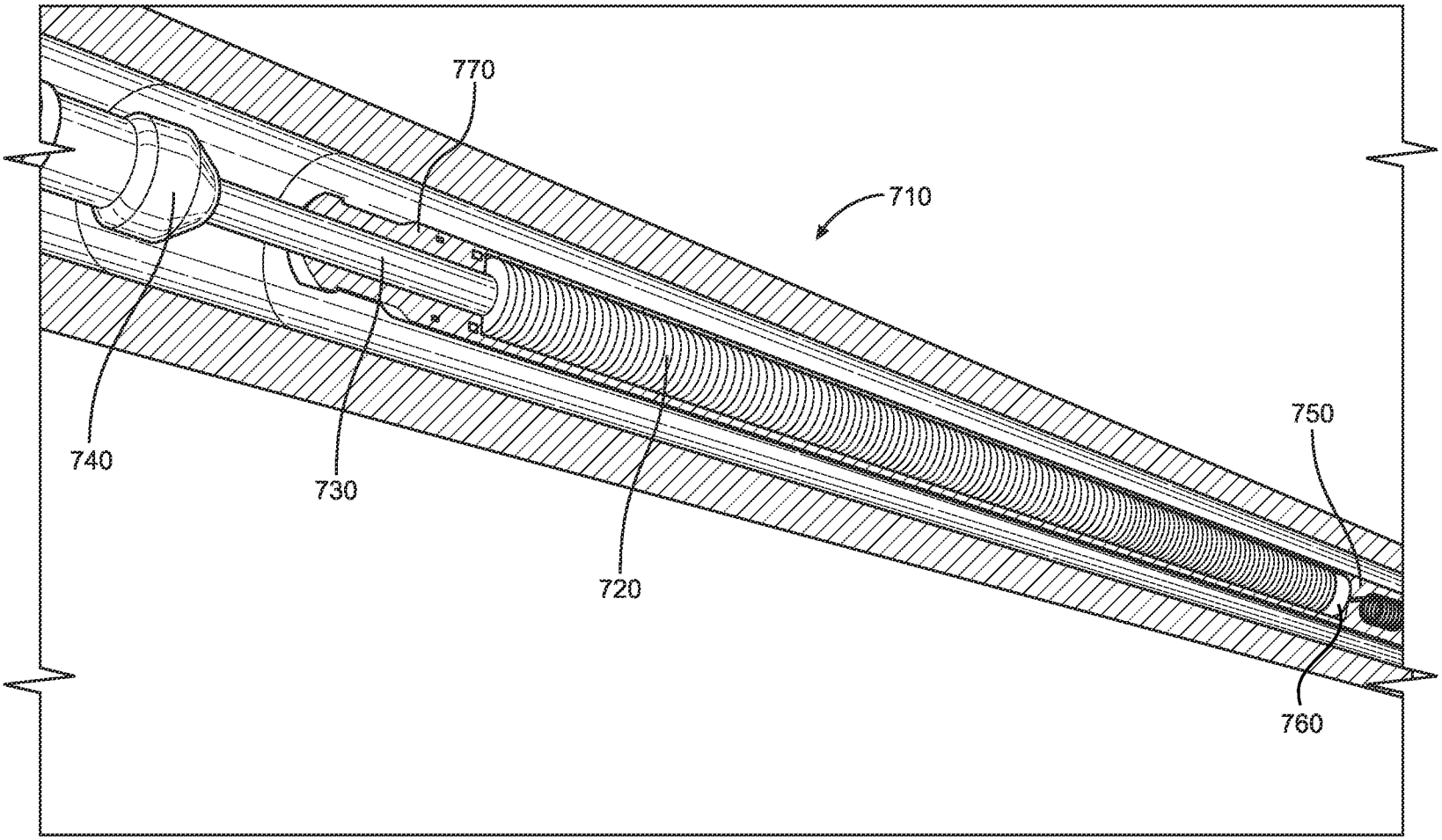
FIG. 7A is an illustration of an example accelerator assembly of the mechanical service tool in a first position.
Figure 7B:
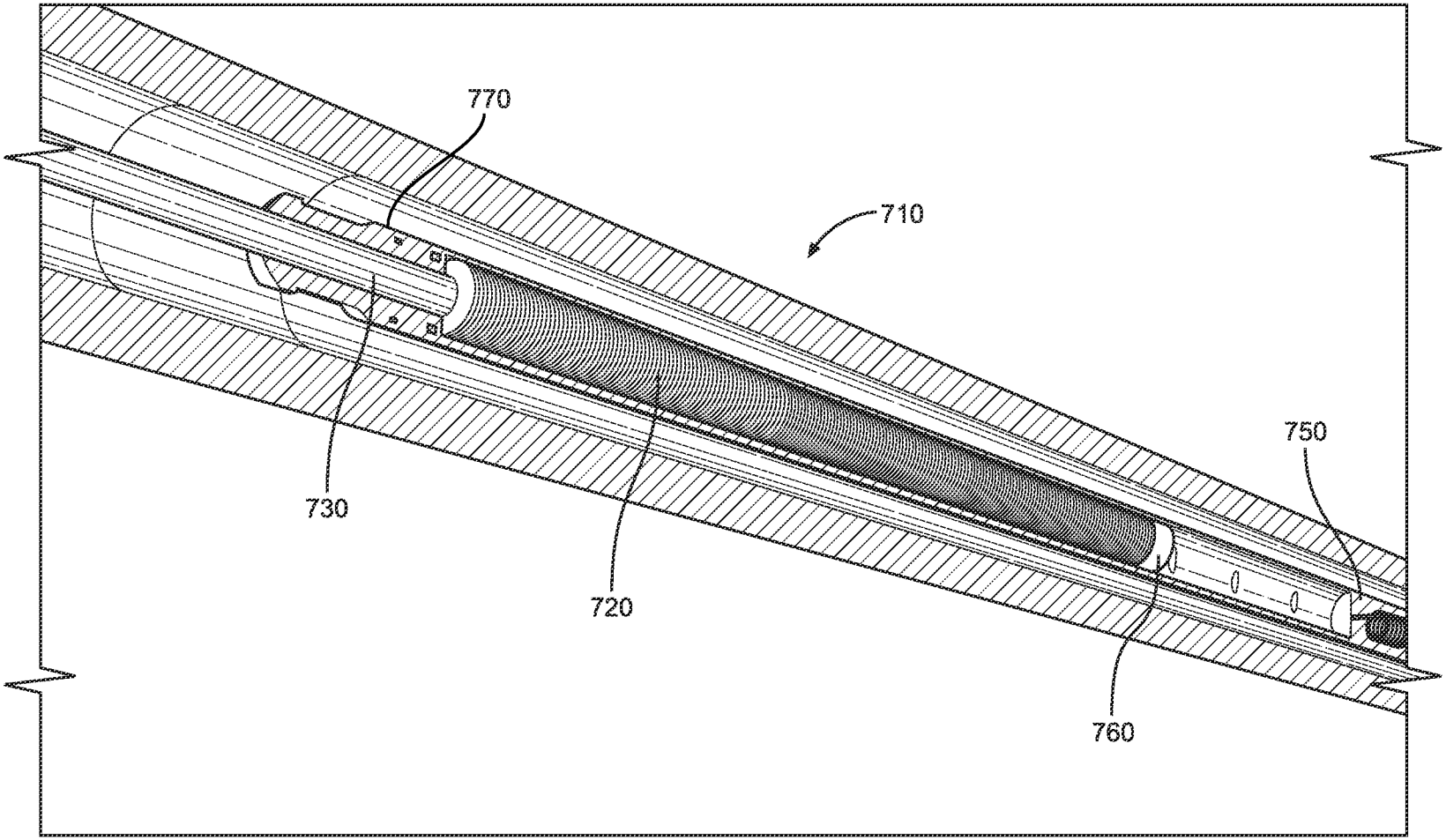
FIG. 7B is an illustration of an example accelerator assembly of the mechanical service tool in a second position.

FIG. 7A provides an illustration of an example accelerator assembly 710 of the mechanical service tool in a first position, while FIG. 7B is an illustration of the accelerator assembly 710 in a second position. The accelerator 710 includes an accelerator spring 720. In FIG. 7A, the accelerator spring 720 is in an uncompressed state with its end cap 760 abutting the bump stop 750. FIG. 7A also shows a plunger 740 attached to a rod 730. In some examples, the rod 730 extends through the accelerator spring 720 to the end cap 760 on the far side of the accelerator spring 720. The end cap 760 can be sized such that it retains one end of the accelerator spring 720, allowing for compression.

When the plunger 740 moves in a direction away from the accelerator spring 720, it pulls the rod 730 and end cap 760 in that same direction, causing the accelerator spring 720 to compress. FIG. 7B shows the accelerator spring 720 in the compressed, or second, position. The plunger 740 can be pulled based on tension in the wireline and/or by actuation of the linear actuator as described previously. The linear actuator can be configured such that its stroke is longer than the stroke of the accelerator 710. That is, after compressing the spring to its fully compressed position such as in FIG. 7B, the linear actuator can continue pulling the accelerator assembly 710. This additional pulling can cause the jar tool to be energized and fired. In a scenario where the jar tool has already fired and has not been reset, continued pulling by the linear actuator can exert a pulling force on the target object coupled to the jar tool. In another example, the accelerator spring 720 is partially compressed by way of applying cable tension to the entire tool, after which the anchor is deployed (or redeployed) and the linear actuator can continue compressing the accelerator spring 720 and/or jar tool. This can help account for a linear actuator with a stroke that is too short to fully compress the accelerator and/or jar tool.

The accelerator assembly 710 of FIGS. 7A and 7B also includes a housing 770 that surrounds the accelerator spring 720 and at least a portion of the rod 730. As shown in the drawings, the housing 770 includes a sidewall that extends the length of the accelerator spring 720 and includes the bump stop 750. In some examples, the housing 770 remains fixed (relative to the rod 730) while the plunger 740 pulls the rod 730 and compresses the spring 720. The housing 770 can be coupled to other components of the tool. For example, the housing 770 can be coupled to a hammer of a jar tool such that when the jar tool fires, the hammer and housing 770 move together until the hammer impacts the anvil. In that example, the accelerator spring 720 provides additional force to move the hammer faster than the jar tool could manage alone, causing a larger impact against the anvil and thereby applying a higher magnitude impulse to the target object.

Figure 8:
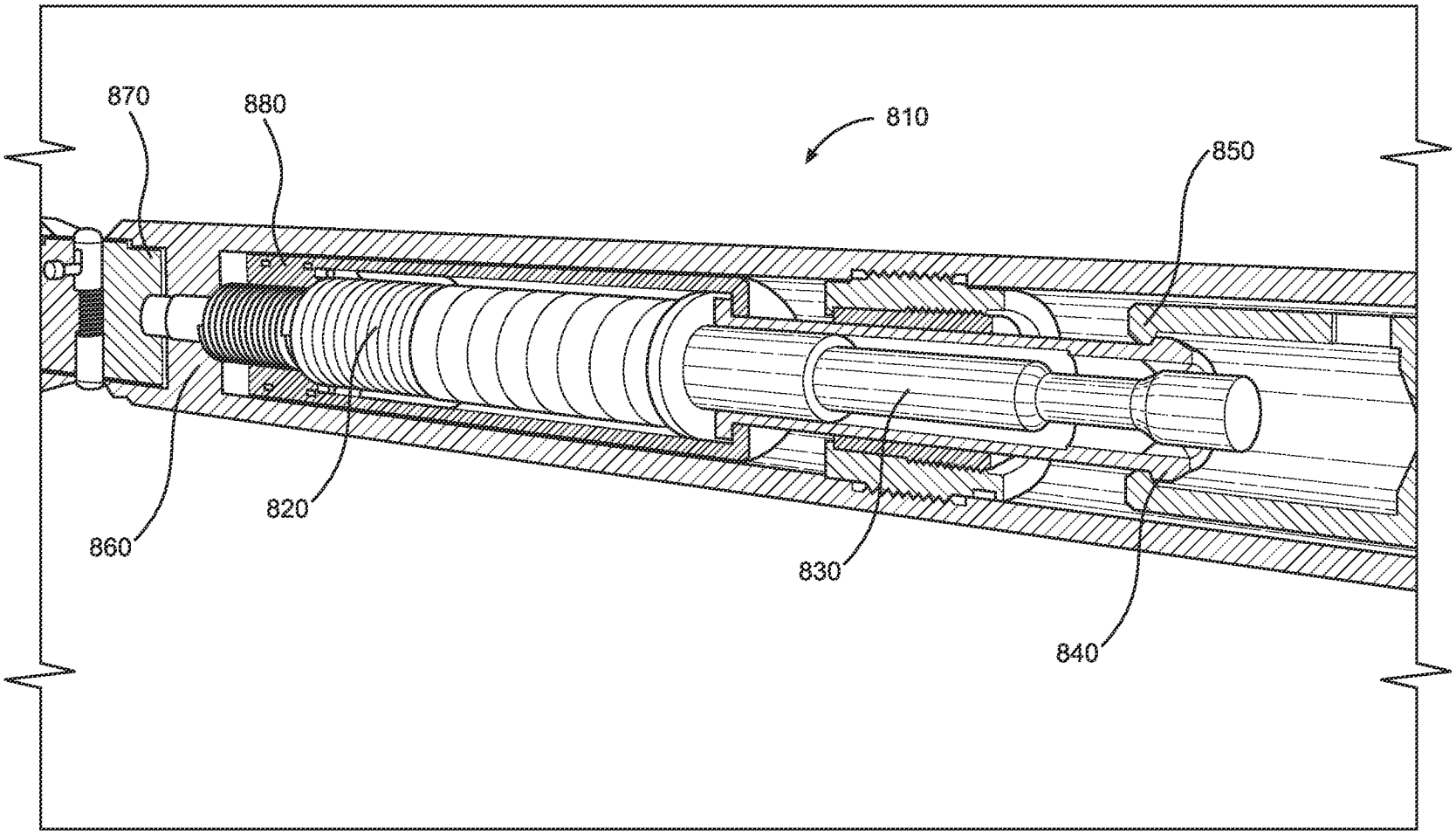
FIG. 8 is an illustration of an example jar tool of the mechanical service tool disclosed herein.

FIG. 8 provides an illustration of an example jar tool 810 that can be coupled to the accelerator 710 of FIGS. 7A and 7B. The jar tool 810 can also be coupled to a target object to be loosened or removed from the wellbore. As shown in FIG. 8, the jar tool 810 can include a set of springs 820. These springs 820 can be coil springs, disc springs, or any other type of spring that stores energy by way of being extended or compressed by the accelerator 710. In the example of FIG. 8, the springs 820 include three different types of springs having varying sizes and spring rates. The jar tool 810 can include a pin 830 that guides a collet 840 and can extend through the jar tool 810, including through the springs 820. The collet 840 can catch a shoulder 850, holding the collet 840 and pin 830 in place as the spring 820 is compressed. This position of the jar tool 810 can be considered a "set" or "ready" position. In some examples, the pin 830 is coupled to the housing 770 of the accelerator assembly 710 of FIGS. 7A and 7B, such that lateral displacement of the pin 830 causes an associated lateral displacement of the housing 770.

After a threshold amount of tension has been applied to the jar tool 810, the collet 840 compresses such that it slips off the shoulder 850. Release of the collet 840 causes the jar tool 810 to fire, unloading the energy stored in both the jar springs 820 as well as the accelerator spring 720. This energy is transferred to an anvil 860 based on an impact from a hammer 880 portion of the jar tool 810. This impact creates an impulse that is sent through the target object. The hammer 880 and anvil 860 can be arranged in various different manner, with different components functioning as the hammer 880 and anvil 860 respectively. For example, in FIG. 8, the hammer 880 can be a housing that at least partially surrounds the jar spring 820, while the anvil 860 is an outer housing positioned around the hammer 880 housing. A gap is shown between the hammer 880 and anvil 860 in FIG. 8, but this distance can be configured based on spring rates, spring lengths, and other design factors. This distance is then closed by the hammer 880 impacting the anvil 860.

In another example, the hammer can be a mass (not shown) coupled to the opposite end of the jar tool 810, such as by being coupled to the sidewalls of element 860 (at a location proximate the distal end of pin 830). In that example, the hammer moves with element 860 as element 860 is pulled away from element 880 (which maintains its relative position) and as the springs 820 are loaded. Shoulder 850 can function as an anvil in this example, maintaining its relative position during the loading and firing processes. When the jar tool 810 fires, element 860 and the coupled mass can be accelerated in the direction of pulling. This causes the mass to impact the shoulder 850, such as a portion of the shoulder 850 not shown in FIG. 8 that uses thicker sidewalls that can more readily absorb and transfer the impact. The present disclosure is not intended to be limited based on the configuration or placement of the hammer and anvil.

After firing, the jar tool 810 can be considered to be in a "released" position. The linear actuator can be used to push the jar tool 810 in the other direction, causing the collet 840 to be pushed back inside the shoulder 850 to lock into the set position. Even after the jar tool 810 is returned to its set position, the linear actuator can continue its stroke in order to apply a pushing or pulling force to the target object, depending on the orientation. The firing process can then be repeated.

Figure 9:
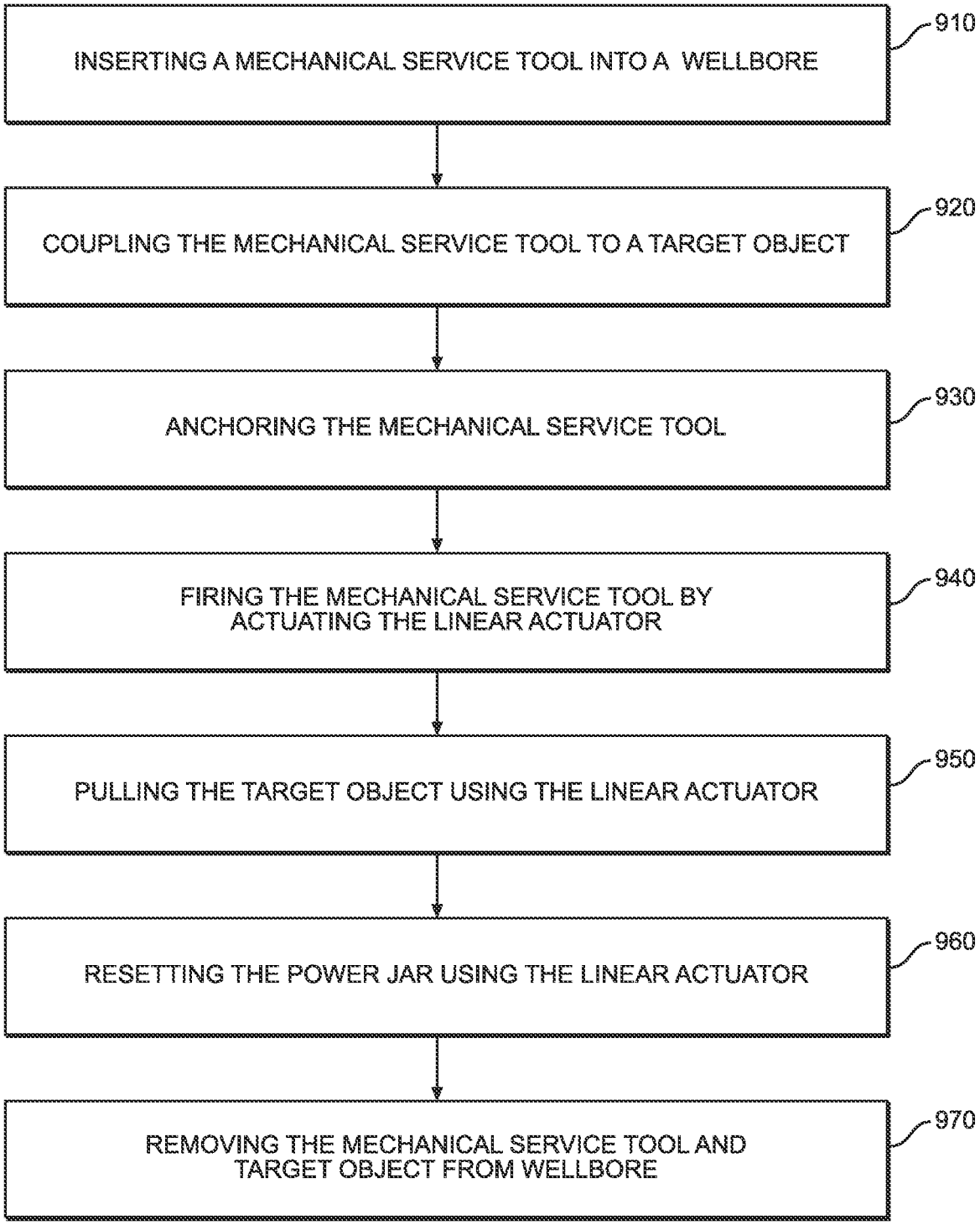
FIG. 9 is a flowchart of an example method utilizing the mechanical service tool disclosed herein.

FIG. 9 is a flowchart of an example method utilizing the mechanical service tool disclosed herein. At stage 910, the method can include inserting a mechanical service tool into a wellbore, such as by lowering it down the wellbore using a wireline. At stage 920, the mechanical service tool can be coupled to a target object. This stage can be performed using one or more hooks, mechanical fasteners, or any other coupling devices that allow substantial force to be transferred between the mechanical service tool and the target object without breaking the connection between the two.

At stage 930, the mechanical service tool can be anchored in the wellbore. This can be performed by extending anchor arms on an anchor portion of the tool, such that the arms contact the inner surface of the wellbore or casing. In some examples, stage 930 occurs before loading the accelerator and/or jar tool, as described in subsequent steps. However, in some examples, it can be desirable to preload the accelerator and/or jar tool before using the linear actuator. For example, the linear actuator may not have sufficient stroke to fully compress the accelerator and jar tool. To avoid the need for a custom-designed linear actuator, a preloading strategy can be used.

The preloading can be performed by applying wireline cable tension in one example. As explained with respect to FIG. 3, the tool can include a head assembly 320 with a sensor 325 that measures the cable tension experienced as the head assembly 320. This is useful because surface tension measurements are inherently unreliable indicators of cable tension experienced at the tool, especially in highly deviated wells that are more likely to require a jar tool. The sensor 325 can be used to ensure sufficient tension is applied to preload the springs without firing the jar tool. In an example method, cable tension can be applied in an amount less than the tension required to fire the jar tool. As an example, cable tension can be used to apply approximately 50% of the tension required to fire the jar tool. This number is exemplary only and would be useful to pretension the springs of the accelerator and jar tool while leaving a sufficient margin of safety for avoiding firing the jar tool. Other percentages can be applied as well, as long as they do not cross the threshold for firing the jar tool. After the cable pull pretensions the springs, the mechanical service tool can be anchored in the wellbore as described above and the method can continue.

At stage 940, the linear actuator of the mechanical service tool can be actuated in a direction and to an extent sufficient to fire the jar portion of the mechanical service tool. Further actuation of the linear actuator can exert a pulling force to the target object at stage 950. This can be performed without resetting the jar tool in an example.

At stage 960, the jar tool can be reset using the linear actuator. For example, the linear actuator can be actuated in the direction opposite to the direction used to fire the jar tool. This actuation can return the jar tool to its ready position. Additional stages, not shown in FIG. 9, can include repeatedly firing and resetting the jar tool. This allows for multiple impulses to be applied to the target object. At stage 970, when the target object has been sufficiently loosened within the wellbore, an operator can remove the mechanical service tool and coupled target object from the wellbore.

Other examples of the disclosure will be apparent to those skilled in the art from consideration of the specification and practice of the examples disclosed herein. Though some of the described methods have been presented as a series of steps, it should be appreciated that one or more steps can occur simultaneously, in an overlapping fashion, or in a different order. The order of steps presented are only illustrative of the possibilities and those steps can be executed or performed in any suitable fashion. Moreover, the various features of the examples described here are not mutually exclusive. Rather any feature of any example described here can be incorporated into any other suitable example. It is intended that the specification and examples be considered as exemplary only, with a true scope and spirit of the disclosure being indicated by the following claims.

What is claimed is:

1. A mechanical service tool comprising:

a power jar, the power jar comprising a jar spring and a hammer, wherein the jar spring is configured to impart a force on the hammer, and wherein the hammer releases based on a threshold level of force and produces an impulse upon impact with an anvil;

an accelerator coupled to the power jar and comprising an accelerator spring that transfers force to the power jar, wherein release of the hammer causes the accelerator spring to release and impart an additional force to the hammer;

a linear actuator coupled to the accelerator and configured such that actuation of the linear actuator imparts force to the accelerator; and an anchor configured to secure a portion of the linear actuator relative to a wellbore, such that the linear actuator can operate the accelerator without moving the mechanical service tool within the wellbore.

2. The mechanical service tool of claim 1, wherein the linear actuator is configured to impart force to the accelerator sufficient to activate the power jar when the power jar is in a set state.

3. The mechanical service tool of claim 1, wherein the linear actuator is configured to pull the power jar when the power jar is in a released state.

4. The mechanical service tool of claim 1, wherein the linear actuator is configured to move the power jar from a released state to a set state.

5. The mechanical service tool of claim 1, wherein the power jar transitions between a released state and a set state based on a collet being released or set, respectively.

6. The mechanical service tool of claim 1, wherein the power jar comprises an electrical release that is configured to release based on receiving an electrical signal.

7. The mechanical service tool of claim 6, wherein the electrical release is configured to transition the power jar between a released state and a set state without mechanical movement of the power jar.

8. The mechanical service tool of claim 1, further comprising a release device coupled to at least one of the accelerator and the power jar.

9. The mechanical service tool of claim 1, further comprising at least one of a force sensor and a position sensor configured to measure the force or position, respectively, of the linear actuator at a point in time.

10. A method for operating a mechanical service tool, the method comprising:

inserting the mechanical service tool into a wellbore, the mechanical service tool comprising:

a power jar, the power jar comprising a jar spring and a hammer, wherein the jar spring is configured to impart a force on the hammer, and wherein the hammer releases based on a threshold level of force and produces an impulse upon impact with an anvil;

an accelerator coupled to the power jar and comprising an accelerator spring that transfers force to the power jar, wherein release of the hammer causes the accelerator spring to release and impart an additional force to the hammer; and a linear actuator coupled to the accelerator and configured such that actuation of the linear actuator imparts force to the accelerator;

coupling the mechanical service tool to a target object;

anchoring the mechanical service tool by extending one or more anchors; and firing the mechanical service tool by actuating the linear actuator.

11. The method of claim 10, further comprising applying tension to a cable attached to the mechanical service tool, wherein the tension at least partially compresses the accelerator spring.

12. The method of claim 11, wherein the anchoring occurs subsequent to applying the tension to the cable.

13. The method of claim 11, wherein applying tension comprises applying tension based on tension measurements generated by a sensor in a head assembly of the mechanical service tool.

14. The method of claim 10, further comprising actuating the linear actuator to apply a pulling force to the target object without firing the mechanical service tool.

15. The method of claim 10, further comprising actuating the linear actuator to reset the power jar to a set state.

16. The method of claim 10, wherein the power jar transitions between a released state and a set state based on a collet being released or set, respectively.

17. A method for operating a mechanical service tool, the method comprising:

inserting the mechanical service tool into a wellbore, the mechanical service tool comprising:

a power jar, the power jar comprising a jar spring and a hammer, wherein the jar spring is configured to impart a force on the hammer, and wherein the hammer releases based on a threshold level of force and produces an impulse upon impact with an anvil;

an accelerator coupled to the power jar and comprising an accelerator spring that transfers force to the power jar, wherein release of the hammer causes the accelerator spring to release and impart an additional force to the hammer; and a linear actuator coupled to the accelerator and configured such that actuation of the linear actuator imparts force to the accelerator;

coupling the mechanical service tool to a target object;

firing the mechanical service tool by actuating the linear actuator;

wherein the mechanical service tool is supported by a cable fed from a surface level, and wherein firing the mechanical service tool is performed without applying additional tension to the cable.

18. The method of claim 10, further comprising removing the mechanical service tool from the wellbore, wherein removing the mechanical service tool causes the target object to be removed from the wellbore.

19. The method of claim 10, further comprising centralizing the mechanical service tool within the wellbore by extending a plurality of anchors.

20. The method of claim 17, further comprising centralizing the mechanical service tool within the wellbore via a plurality of anchors.

* * * * *